United States Patent [19]

Kasai et al.

[11] Patent Number: 4,866,776

[45] Date of Patent: Sep. 12, 1989

[54] AUDIO SPEAKER SYSTEM FOR AUTOMOTIVE VEHICLE

[75] Inventors: Junichi Kasai; Hiroshi Imai; Takayuki Yanagishima, all of Kanagawa, Japan

[73] Assignee: Nissan Motor Company Limited, Yokohama, Japan

[21] Appl. No.: 665,110

[22] Filed: Oct. 26, 1984

[30] Foreign Application Priority Data

Nov. 16, 1983 [JP] Japan ..... 58-215604

[51] Int. Cl.[4] ..... H04R 5/02

[52] U.S. Cl. ..... 381/24; 381/86

[58] Field of Search ..... 381/86, 24, 1, 18

[56] References Cited

U.S. PATENT DOCUMENTS

| | | | |
|---|---|---|---|
| 4,164,625 | 8/1979 | Igeta | 381/86 |
| 4,490,842 | 12/1984 | Watanabe | 381/86 |
| 4,509,184 | 4/1985 | Yanagawa | 381/24 |
| 4,514,599 | 4/1985 | Yanagashima et al. | 381/86 |
| 4,521,906 | 6/1985 | Kahn | 381/24 |
| 4,524,451 | 6/1985 | Watanabe | 381/1 |
| 4,574,391 | 3/1986 | Morishima | 381/18 |
| 4,594,729 | 6/1986 | Weingartner | 381/24 |

FOREIGN PATENT DOCUMENTS

| | | | |
|---|---|---|---|
| 2021214 | 11/1971 | Fed. Rep. of Germany | 381/86 |
| 56-110400 | 9/1981 | Japan . | |
| 58-53300 | 3/1983 | Japan . | |
| 57-70000 | 4/1983 | Japan . | |
| 58-19020 | 11/1983 | Japan . | |
| 58-70610 | 4/1986 | Japan . | |

*Primary Examiner*—Forester W. Isen

*Attorney, Agent, or Firm*—Lane & Aitken

[57] ABSTRACT

An automotive audio speaker system includes a set of main speakers and a set of sub-speakers. The main speakers are distributed about the vehicle cabin so as to focus audio sound near the center thereof. The main speakers reproduce separate right and left audio channels, either singly or in groups, and the sub-speakers reproduce monaural sound resulting from combination of the right and left channels. The sub-speakers are arranged and operated in such a manner that the audio focus is divided and displaced to form a number of acoustic images, each coinciding with a passenger seat. Seat sensors capable of detecting the presence of a passenger in a corresponding seat may be used to control the operation of the sub-speakers, either by adjusting their relative volumes or by distributing the right and/or left audio channels thereamong.

10 Claims, 8 Drawing Sheets

AUDIO SPEAKER SYSTEM FOR AUTOMOTIVE VEHICLE

BACKGROUND OF THE INVENTION

The present invention relates generally to a speaker system for an automotive audio system. More particularly, the invention relates to a multi-speaker system including a plurality of speakers for stereo-sound reproduction in a vehicle cabin.

Various arrangements of automotive audio speakers are available on the market. Such speaker systems reproduce stereo sound by means of a plurality of speakers to create a stereo acoustic image. The speakers are arranged in the vehicle cabin so that acoustic image or images are formed at suitable points of the vehicle cabin to provide high-quality audio sound. Some speaker systems also employ fader controls and balance controls for adjusting the acoustical pressure produced by each speaker or set thereof.

In another approach, one or more sub-speakers are provided to cooperate with main speakers of the speaker systems. Such a speaker system has been disclosed in Published Japanese Patent Application (Tokkai) Showa No. 58-190200, published on Nov. 7, 1983. In the disclosed system, main speakers reproduce the right- and left-channels of audio sound, and the sub-speakers reproduce monaural sound. This disclosed system is designed to provide higher-quality audio sound for the automotive audio system than even a home stereo system.

However, in this conventional speaker system, it is not always possible to form the acoustic image at points in the vehicle cabin coinciding with the passengers' listening positions. This noticeably degrades the audio sound.

SUMMARY OF THE INVENTION

Therefore, it is an object of the invention to provide a speaker system which can reproduce high-quality stereo sound at any point in the vehicle cabin.

Another and more specific object of the present invention is to provide an automotive speaker system which is capable of forming a plurality of acoustic images within the vehicle cabin so that every passenger can sit at or near an acoustic image.

In order to accomplish the above-mentioned and other objects, a speaker system for an automotive audio system, according to the present invention, comprises a plurality of main speakers arranged in the vehicle cabin to form an acoustic image at or near the center of the vehicle cabin, and one or more sub-speakers arranged in the vehicle cabin in cooperation with the main speakers for forming a plurality of acoustic images, at least one for each passenger seat.

In the preferred construction, passenger seat the spatial distribution of passengers is detected and audio signals supplied to the sub-speakers are controlled depending upon where passengers are sitting.

In another preferred construction, front and rear pairs of sub-speakers are installed near the central axis of the vehicle cabin. Each sub-speaker is directed toward a corresponding passenger's seat so that reproduced acoustic vibrations are directed towards the corresponding passenger's seat.

In a further preferred construction, a plurality of sub-speakers are mounted on the backs of the front seats. These sub-speakers direct their acoustic vibrations towards the rear seats.

Preferably, signal levels of the right and left channels supplied to the main and/or sub speakers are controlled. Such signal level control for the sub-speakers is performed in accordance with the signal level difference between the right- and left-channels.

BRIEF DESCRIPTION OF THE DRAWINGS

The present invention will be understood more fully from the detailed description given herebelow and from the accompanying drawings of the preferred embodiment of the present invention, which, however, should not be taken to limit the invention to the specific embodiment but are for explanation and understanding only.

In the drawings.

DESCRIPTION OF THE PREFERRED EMBODIMENT

Figure 1:
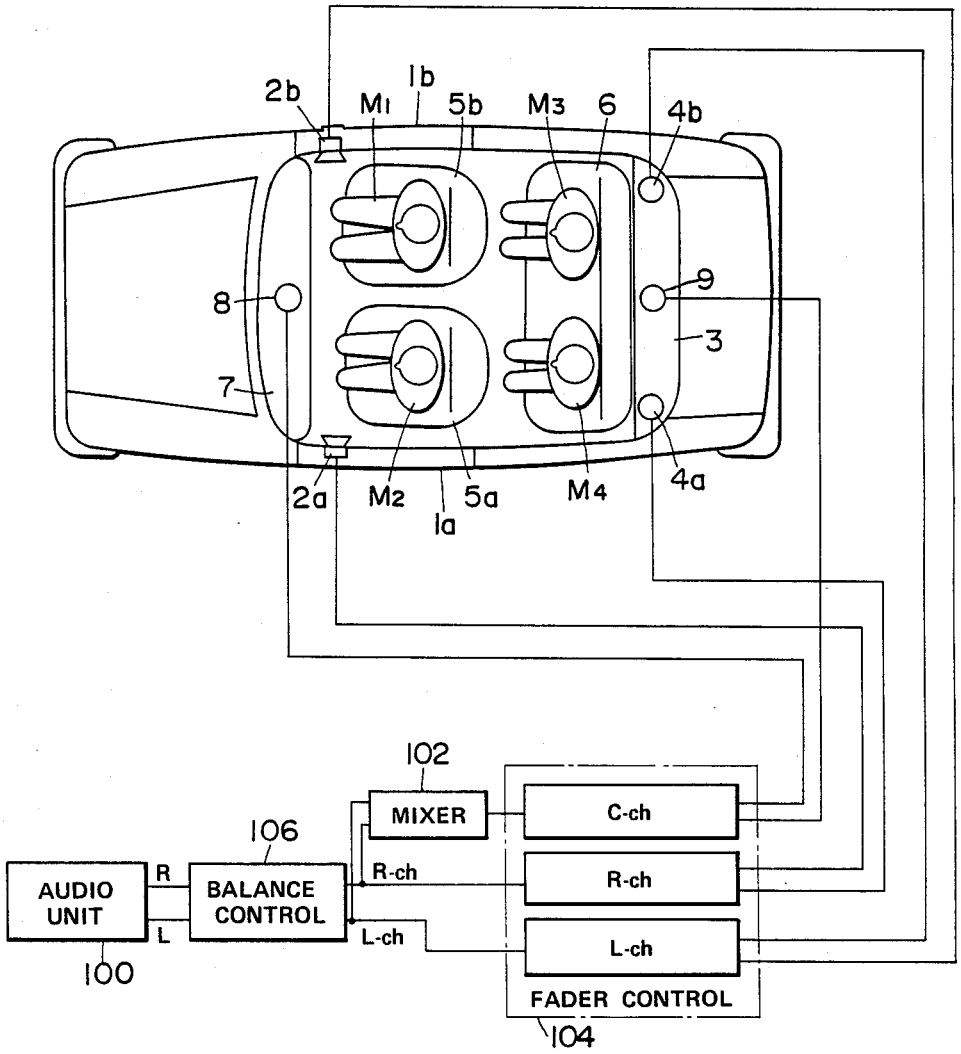
FIG. 1 is a plan view of a vehicle equipped with the first embodiment of a speaker system in accordance with the present invention.

Referring now to the drawings, particularly to FIG. 1, the first embodiment of a speaker system generally comprises a pair of front speakers 2*a* and 2*b*, a pair of rear speakers 4*a* and 4*b* and sub-speakers 8 and 9. All of the speakers are connected to an audio unit 100 to receive electrical audio signals which are transduced by the speakers into acoustic vibrations.

One front speaker 2*a* is mounted on the right-front door 1*a* and the other front speaker 2*b* is mounted on the left-front door 1*b*. Hereafter, the speaker 2*a* mounted on the right-front door 1*a* will be referred to as "right-front speaker" and the speaker 2*b* mounted on the left-front door 1*l* will be referred to as "left-front speaker". One rear speaker 4*a* is mounted near the right-hand end of a rear parcel shelf 3 and the other rear speaker 4*b* is mounted near the left-hand end of the rear parcel shelf. Hereafter, the rear speaker mounted on the right side of the rear parcel shelf 3 will be referred to as "right-rear speaker" and the speaker 4b mounted on the left side of the rear parcel shelf will be referred to as "left-rear speaker". The sub-speaker 8 is mounted on an instrument panel 7, and will hereafter be referred to as "front sub-speaker". The sub-speaker 9 is mounted at the center of the rear parcel shelf 3 and will be referred to hereafter as "rear sub-speaker".

The right and left channels of the stereo signal are conducted to the right- and left-hand sets of speakers 2a, 4a and 2b, 4b respectively. The front- and rear sub-speakers 8 and 9 receive both channels of the stereo signal via a mixer 102. Audio signal levels for the front set of speakers 2a and 2b and the rear set of speakers 4a and 4b can also be adjusted, which will be referred to as "fader control". Fader control is performed by means of a fader controller 104 connected to the audio unit. The fader control state at which the audio signals supplied to the front and rear speakers match will be referred to as the "fader-neutral position". Audio signal levels for the right-side speakers 2a and 4a and the left-side speakers 2b and 4b can also be adjusted. Adjustment of right- and left-side balance of the signal levels will be referred to hereafter as "balance control". This balance control is performed by a balance controller 106 connected between the audio unit and the fader control. The balance control state at which equal audio signal levels are supplied to both sides will be referred to as "balance neutral position". The combination of the fader neutral position and the balance neutral position will be hereafter referred to as the "all position".

The relative audio signal levels supplied to the front and rear sub-speakers 8 and 9 are determined by the fader controller 104. On the other hand, the relative right-channel and left-channel mixer levels entering the mixer 102 are determined by the balance controller 106. In practice, at the all position, the audio signal levels supplied to the front- and rear sub-speakers 8 and 9 are equal, as are the mixed levels of right- and left channels.

Assuming four passengers M1, M2, M3 and M4 in the vehicle cabin are distributed evenly between the front and rear seats 5 and 6, each passenger will be seated near a corresponding acoustic image generated at the occupied seat by the effect of front and rear sub-speakers 8 and 9. With regard to the listening zone around the driver's seat 5b occupied by the driver M2, if the front sub-speaker 8 were not installed or effective, the acoustic image formed by acoustic vibrations created by the front and rear speakers 2a, 2b, 4a and 4b in all-position mode would be located outside of the driver's listening zone. Specifically, in this case, the acoustic image would be formed closer to the center of the vehicle cabin. The right audio channel is stronger at the driver's ear than the left channel. The combined right-and left-channel sound reproduced by the front sub-speaker interferes with acoustic vibrations produced by the right front speaker 2a. On the other hand, since, the direction of transmission of vibrations from the left-front speaker is approximately the same as that of the front sub-speaker, the acoustic vibrations from the front sub-speaker 8 will tend to interfere constructively with the acoustic vibrations from the left-front speaker 2b. As a result, the acoustic vibration amplitudes near the driver's ear would approximately balance to form a clear acoustic image. Therefore, the driver can enjoy stereo sound with good balance between the right and left audio channels.

Similar effects are achieved for the passengers M1, M3 and M4 due to the effect of the front and rear sub-speakers 8 and 9.

For instance, according to the shown embodiment, a plurality of acoustic images are formed in the vehicle cabin to provide each passenger with his order own acoustic image. Therefore, high-quality stereo sound can be enjoyed at any seat position.

If another passenger is sitting in between the passengers M3 and M4, the listening zone of this passenger falls just in front of the rear sub-speaker 9. The strongest acoustic vibrations will be due to the rear sub-speaker 9 in this case. The acoustic vibrations from the rear sub-speaker 9 interfere destructively with acoustic vibrations from the rear speakers 4a and 4b predominantly. As a result, a high-quality acoustic image is formed within the listening zone of this passenger as well.

Figure 2:
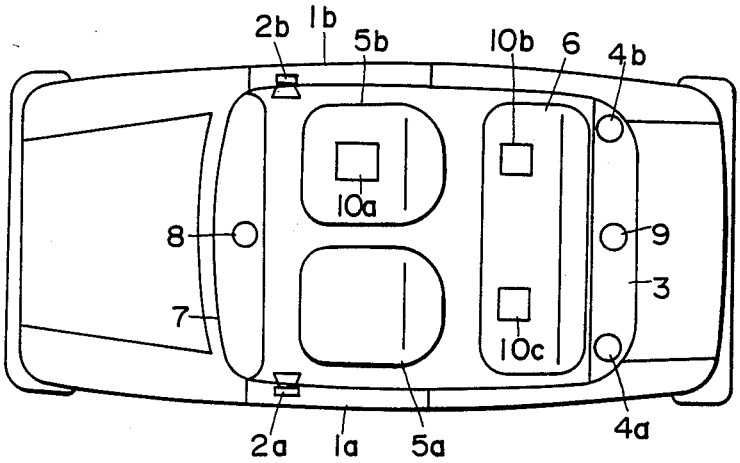
FIG. 2 is a view similar to FIG. 1 but showing the second embodiment of a speaker system in accordance with the present, invention.
Figure 3:
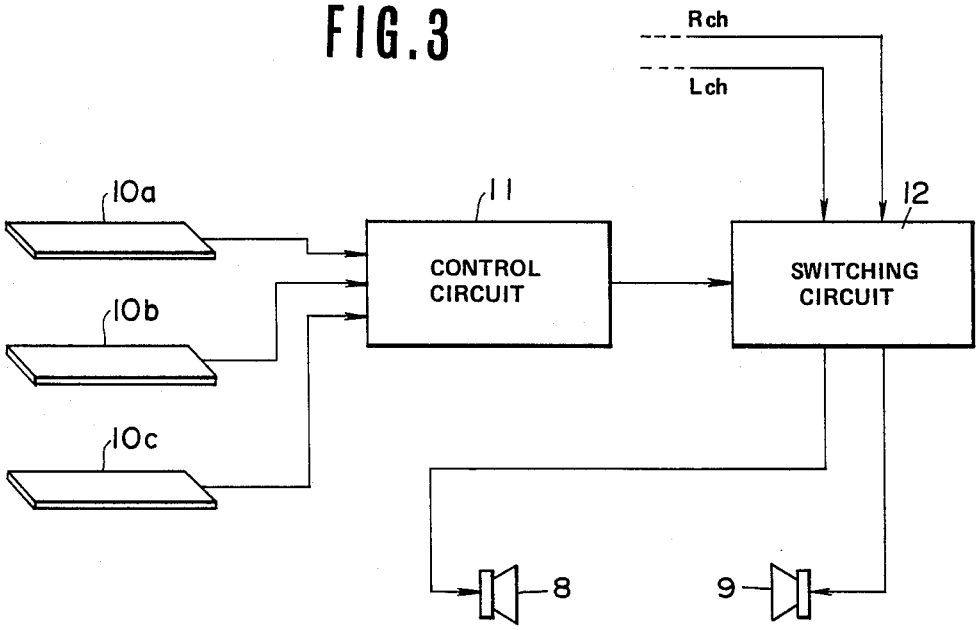
FIG. 3 is a schematic block diagram of an audio control unit associated with the second embodiment of speaker system of FIG. 2.

FIGS. 2 and 3 shows the second embodiment of the speaker system in accordance with the present invention. In this embodiment, arrangement of the speakers per se is substantially the same as that in the foregoing first embodiment. Seat sensors 10a, 10b and 10c are provided within the front passenger seat 5b and left and right sides of the rear seat 6. Each of the seat sensor 10a, 10b and 10c generally comprises a pressure sensor for detecting the presence of an occupant in the corresponding seat.

A seat sensor and its application for detecting occupation of a corresponding vehicle seat for various purpose is already known to the public. For example, U.S. Pat. No. 4,434,932 to Hara et al, issued Mar. 6, 1984 discloses a similar sensor for detecting the presence of a occupant of a corresponding vehicle seat for controlling operation of an automotive automatic air conditioner system. The disclosure of the seat sensor per se and the manner of its use in the above-identified U.S. Patent is hereby incorporated by reference for the sake of disclosure.

The seat sensors 10a, 10b and 10c output HIGH-level sensor signals when the pressure on the seat exceeds a predetermined value. The sensors 10a, 10b and 10c are connected to a control circuit 11 selects the combination of the right and left audio channels for each sub-speaker according to the following table.

Table

| Sensor Output | | | Mixer Level | |
|---|---|---|---|---|
| 10c | 10b | 10a | Sub-speaker 8 | Sub-Speaker 9 |
| 0 | 0 | 0 | L | R + L |
| 0 | 0 | 1 | R + L | R + L |
| 0 | 1 | 0 | R | L |
| 0 | 1 | 1 | R + L | L |
| 1 | 0 | 0 | L | R |
| 1 | 0 | 1 | R + L | R |
| 1 | 1 | 0 | L | R + L |
| 1 | 1 | 1 | R + L | R + L |

The control circuit output informs a switching circuit 12 of the seat sensor states so that the switching circuit 12 can realize the signal combinations shown in the above Table. The switching circuit 12 is connected to an audio signal source, such as a tape player, radio receiver, compact disc player or the like to receive the right and left audio channel signals. A pre-amplifier may be inserted between the audio signal source and the switching circuit 12, though this is not illustrated.

As in the first embodiment, fader control for the sub-speakers 8 and 9 may be performed by the fader controller 104 connected between the switching circuit 12 and the sub-speakers.

When passengers are sitting in the driver's seat and the front passenger seat 5b, the output of the seat sensor 10a goes HIGH (1). Since there are no occupants in the rear seat 6, the outputs of the seat sensors 10b and 10c remain LOW (0). As can be seen in the table, the switching circuit 12 mixes the right and left audio channels (R and L) for output to both sub-speakers the right side of the rear seat 6, only the of the seat sensor 10b goes HIGH. In this case, the control circuit 11 issues-a control signal ordering the switching circuit 12 to conduct only the right audio channel to sub-speaker 8 and only the left audio channel to sub-speaker 9.

As a result, the front sub-speaker 8 reproduces the right channel which tends to reinforce the acoustic vibrations from the relatively distant right-front speaker 2b at the driver's seat 5a. Similarly, the left-channel sound from the rear sub-speaker 9 helps balance the acoustic image at the right-rear seat. In summary, according to this embodiment, the auxiliary acoustic vibrations provided by the sub-speakers are adjusted in accordance with the occupants' positions to enhance the quality and balance of stereo sound.

Figure 4:
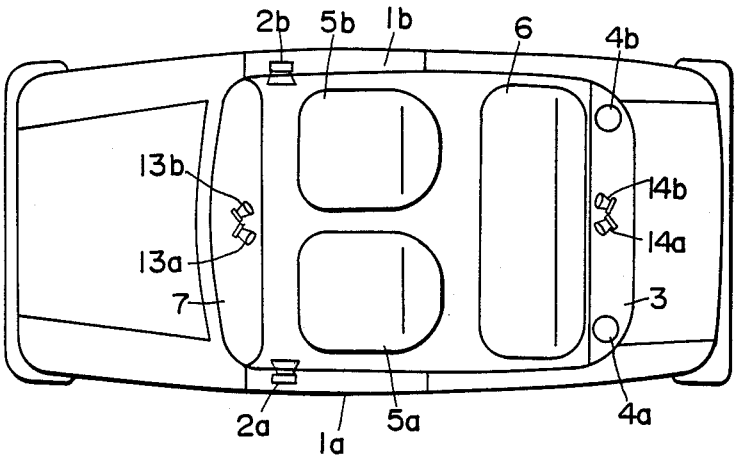
FIG. 4 is a plan view of the vehicle with the third embodiment of a speaker system according to the invention.

FIG. 4 shows the third embodiment of the speaker system according to the present invention. In this embodiment, a pair of front sub-speakers 13a and 13b and a pair of rear sub-speakers 14a and 14b are provided. The front sub-speaker 13a is directed towards the driver's seat 5a. The front sub-speaker 13b is directed towards the front seat 13b. The rear sub-speakers 14a and 14b are also directed towards the right and left sides of the rear seat 6. The sub-speakers 13a and 14a reproduce the left-channel signal and the sub-speakers 13b and 14b reproduce the right-channel signal.

As in to the foregoing embodiments, the acoustic vibrations created by the sub-speakers 13a, 13b, 14a and 14b interfere with acoustic vibrations created by the speakers 2a, 2b, 4a and 4b to form acoustic images at listening zones corresponding to the passenger seat positions. Therefore, at any seat, high-quality stereo sound can be enjoyed.

Although in the aforementioned third embodiment the relative amplitudes of acoustic vibrations created by the sub-speakers are controlled by the fader control, it would also be possible for the signal levels for each sub-speaker to be independent controlled. To enabling individual signal level control, manual controllers 108a, 108b, 108c and 108d would be installed near each passenger seat. As an alternative, a concentrated manually controllable level controller may be used to control the signal levels of each of the sub-speakers relative to the others.

Figure 5:
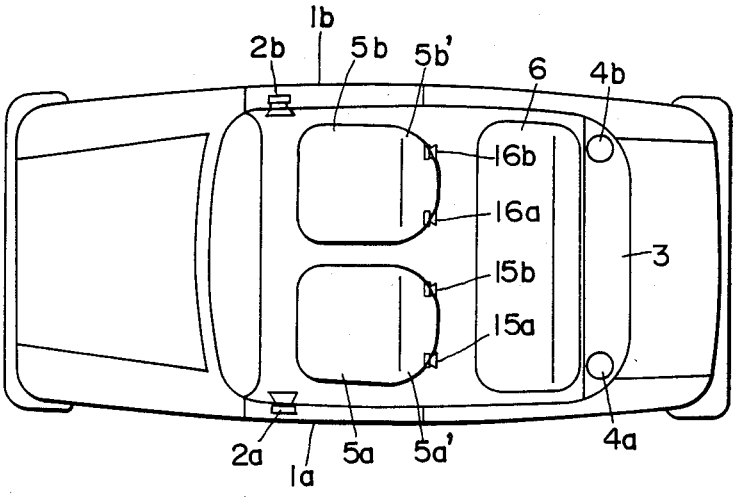
FIG. 5 is a plan view of the vehicle with the fourth embodiment of a speaker system according to the present invention.

FIG. 5 show the fourth embodiment of the speaker system according to the present invention. This embodiment is especially directed toward high-quality stereo sound for occupants of the rear seat.

Figure 6:
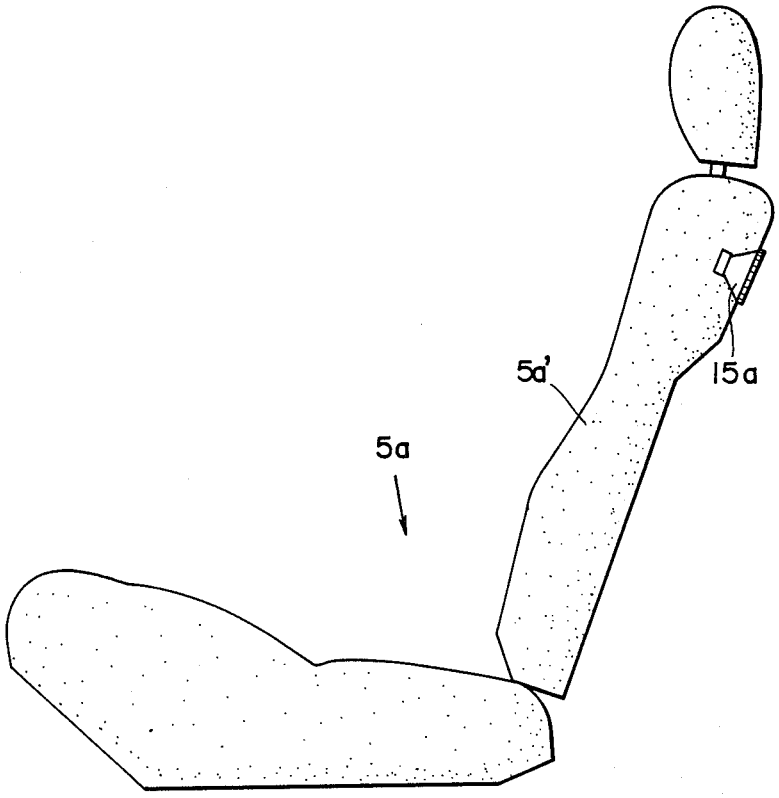
FIG. 6 is a diagram of a speaker mounted on the seat back of a vehicle seat in the fourth embodiment shown in FIG. 5.

Sub-speakers 15a, 15b, 16a and 16b are mounted on the seat backs 5a' and 5b' of the front seats 5a and 5b. As shown in FIGS. 5 and 6, the sub-speakers 15a, 15b, 16a and 16b are mounted near the tops of the seat backs 5a' and 5b' facing the rear seat 6. The sub-speakers 15a and 16a receive the left audio channel; on the other hand, the sub-speakers 15b and 16b receive the right audio channel.

Acoustic vibrations produced by the sub-speakers 15a, 15b, 16a and 16b interact with acoustic vibrations from the rear speakers 4a and 4b, which would otherwise form acoustic images at the center of the vehicle. Interference among the acoustic vibrations produced by the rear speakers 4a and 4b and the sub-speakers 15a, 15b, 16a and 16b results in acoustic images on the right and left sides of the rear seat where the passengers tend to sit.

Figure 7:
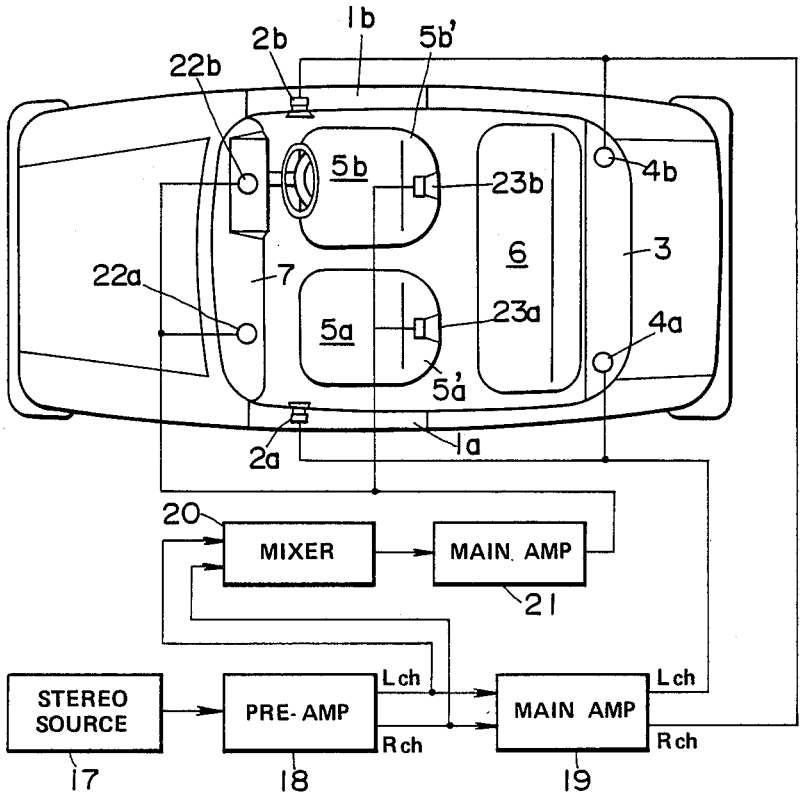
FIG. 7 is a plan view of the vehicle with the fifth embodiment of a speaker system according to the invention.

FIG. 7 shows the fifth embodiment of the speaker system according to the present invention. In this embodiment, a pair of center-channel speakers 22a and 22b are mounted on the instrument panel 7. Each of the center-channel speakers 22a and 22b serves as sub-speakers for the front seat passengers. For the rear seat passengers, a pair of center-channel speakers 23a and 23b are mounted on the seat backs 5a' and 5b' of the front seats 5a and 5b.

Figure 8:
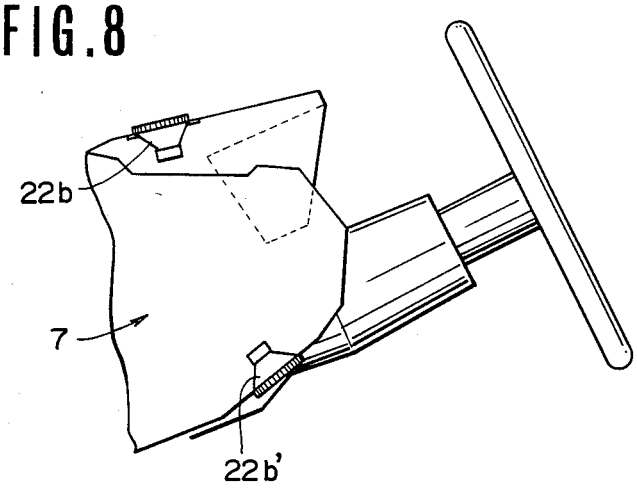
FIG. 8 is a diagram of speakers mounted on the instrument panel of the vehicle in the fifth embodiment of FIG. 7.
Figure 9:
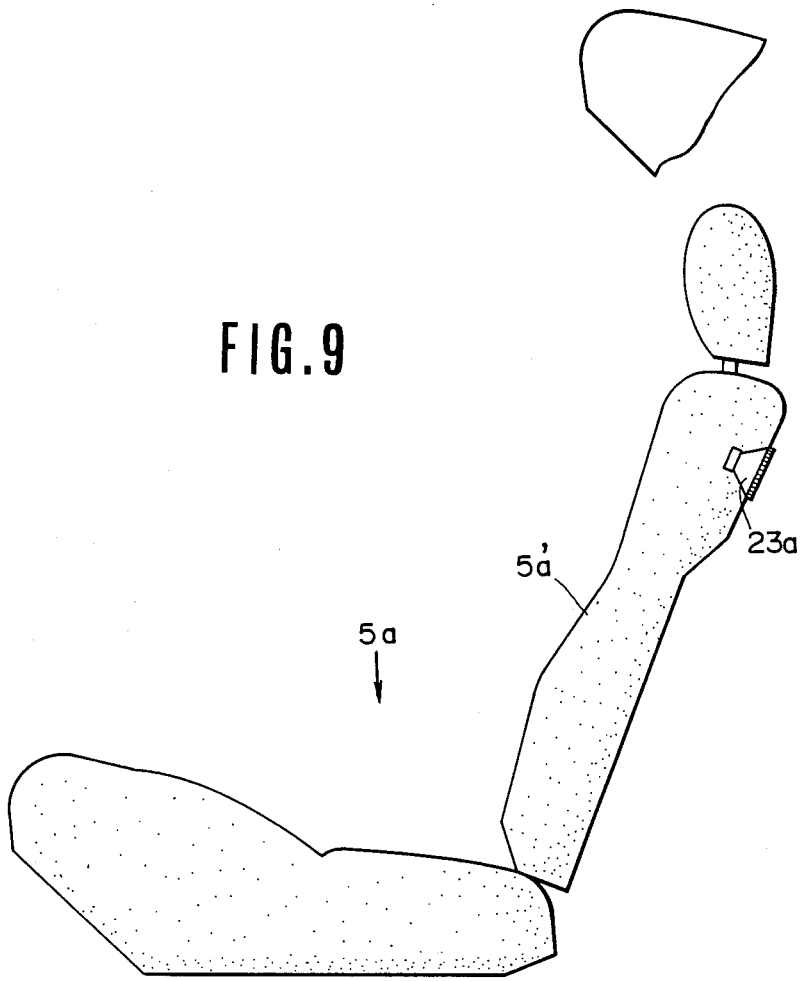
FIG. 9 is a diagram of a speaker mounted on the a seat back of a vehicle seat in the fifth embodiment of FIG. 7.

As shown in FIG. 8, each of the sub-speakers 22a and 22b actually involves both an upper speaker 22a' and 22b' directed upwards and a lower speaker 22a'' and 22b'' directed downwards. The upper speakers 22a' and 22b' are mounted on the upper surface of the instrument panel 7. The lower speaker 22a'' and 22b'' are mounted on the lower surface of the instrument panel 7. As with the sub-speakers 15a, 15b, 16a and 16b, the sub-speakers 23a and 23b are mounted near the tops of the seat backs 5a' and 5b' of the front seats 5a and 5b, as shown in FIG. 9.

The speakers 2a, 2b, 4a and 4b are all connected to a main amplifier 19 which is, in turn, connected to a stereo signal source 17 such as a tape deck, radio tuner, compact disc player or the like via a pre-amplifier 18. On the other hand, the speakers 22a, 22b, 23a and 23b are all connected to a main amplifier 20 which is, in turn, connected to the stereo signal source 17 via the pre-amplifier 18 and a mixer 20.

As is well known, the pre-amplifier 18 divides the signal from the stereo source 17 into right and left audio channels. The main amplifier 19 amplifies the right and left channels of the audio signal separated for use by the speakers 2a, 2b, 4a and 4b. On the other hand, the right and left audio channels separated by the pre-amplifier 18 are recombined by the mixer 20 into a center-channel audio signal. The modulated center audio channel is sent to the main amplifier 21 which amplifies and distributes the modulated center audio channel to each of the sub-speakers 22a, 22b, 23a and 23b.

In this arrangement, each of the left and right channels are reproduced by the speakers 2a, 4a and 2b, 4b, respectively. On the other hand, monaural sound reproduction of the center channel is performed by the sub-speakers 22a, 22b, 23a and 23b. The center-channel acoustic vibrations interfere with acoustic vibrations created by the speaker 2a, 2b, 4a and 4b to form acoustic images in various areas-of the vehicle cabin. The sub-speakers 22a, 22b, 23a and 23b are installed near the passengers seats to form acoustic images within the listening zone of each passenger. This ensures high-quality stereo sound.

Figure 10:
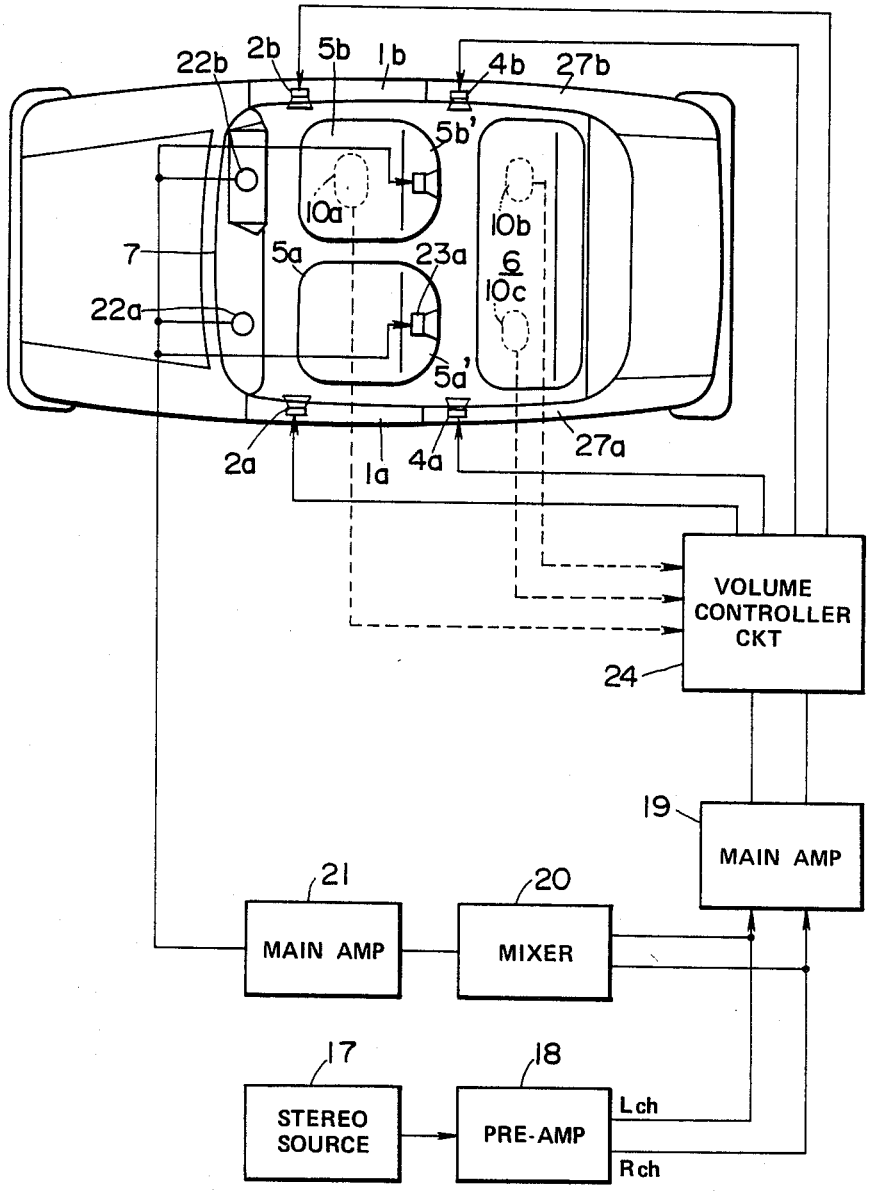
FIG. 10 is a plan view of the vehicle with the sixth embodiment of a speaker system according to the invention.

FIG. 10 shows the sixth embodiment of the speaker system in accordance with the present invention. In this embodiment, front main speakers 2a and 2b are mounted on the front side doors 1a and 1b. The rear main speakers 4a and 4b are mounted on the rear side doors 27a and 27b, instead of on the rear parcel shelf. As in the foregoing fifth embodiment, sub-speakers 22a and 22b are mounted on the instrument panel 7, and the sub-speakers 23a and 23b are mounted on the seat backs 5a' and 5b' of the front seats 5a and 5b.

The seat sensors 10*a*, 10*b* and 10*c* are installed in the front seat 5*b* and the rear seat 6 to detect the presence of passengers occupying the corresponding seats. The seat sensors 10*a*, 10*b* and 10*c* are connected to a volume control circuit 24 which distributes audio signals at individually controlled volumes to each of the main speakers 2*a*, 2*b*, 4*a* and 4*b*. The amplitudes of audio signals distributed among the speakers 2*a*, 2*b*, 4*a* and 4*b* are adjusted according to the distribution of passengers and are independent of the signals sent to the sub-speakers. The volume controller circuit 24 is, in turn, connected to the main amplifier 19.

The volume controller circuit 24 increases the amplitude of audio signals sent to speakers opposing empty seats, as indicated by a LOW-level output from the corresponding seat sensor.

On the other hand, the sub-speakers 22*a*, 22*b*, 23*a* and 23*b* are connected to the mixer 20 via the main amplifier 21. Thus, the sub-speakers all reproduce the monaural output of the mixer 20 at the same volume.

In this arrangement, the audio volume from the speaker or speakers opposing empty seat is increased in order to balance the sound coming from the speakers adjacent the passenger. As a result, the acoustic image formed by the acoustic vibrations from the main speakers 2*a*, 2*b*, 4*a* and 4*b* tends to be displaced from the center of the vehicle cabin toward the passenger seats. The acoustic vibrations created by the sub-speakers 22*a*, 22*b*, 23*a* and 23*b* further interact with the acoustic vibrations created by the main speakers to form acoustic images at each passenger seat.

Figure 11:
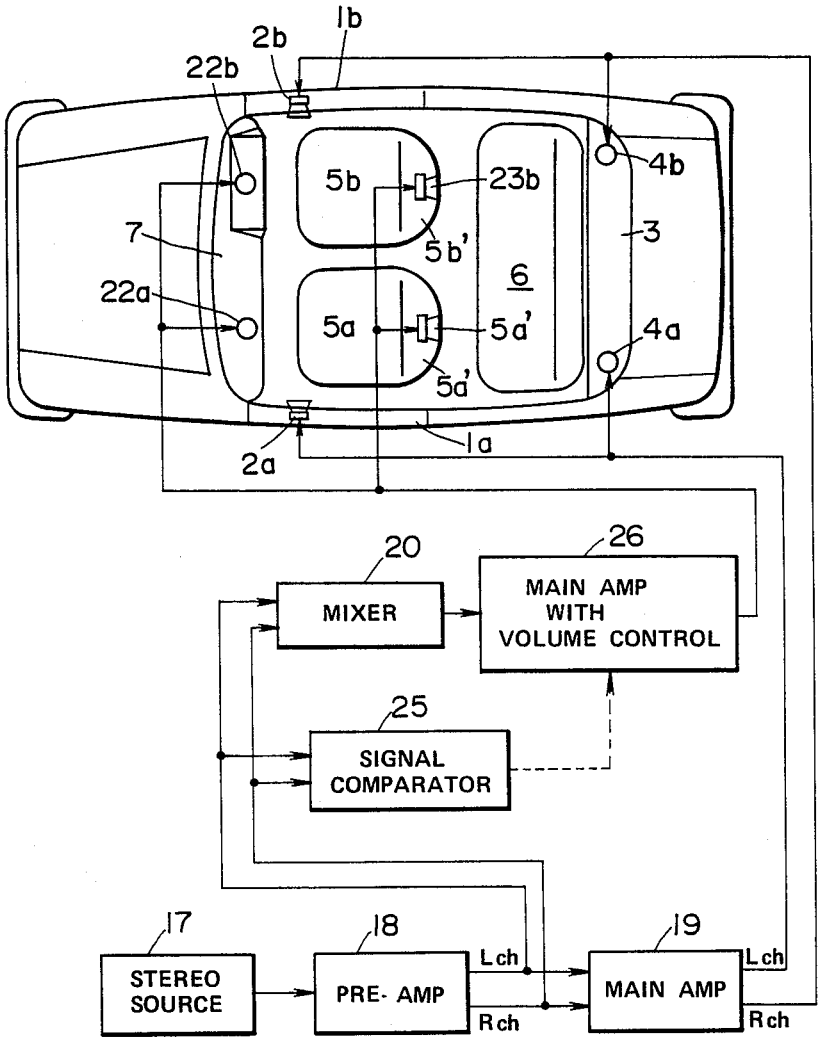
FIG. 11 is a plan view of the vehicle with the seventh embodiment of a speaker system according to the invention.

FIG. 11 shows the seventh embodiment of the speaker system according to the present invention. In this embodiment, the main speakers 2*a*, 2*b*, 4*a* and 4*b* are connected to the stereo source 17 through pre-amplifier 18 and the main amplifier 19. On the other hand, the sub-speakers 22*a*, 22*b*, 23*a* and 23*b* are connected to a main amplifier 26 with an adjustable output volume. The main amplifier 26 is connected to a signal comparator 25 which detects the signal level difference between the right channel and the left channel from the pre-amplifier 18. The signal comparator 25 remains inactive as long as the signal level difference remains less than a reference value, in which case the center-channel audio signal is output at a normal volume to the sub-speakers. On the other hand, when the detected signal level difference is greater than the reference value, the signal comparator 25 become active to control the amplifier 26 to reduce its amplification gain, whereby the center audio channel is reproduced by the sub-speakers at a lower volume.

This satisfactorily prevents interference between the main speakers and the sub-speakers in case where the signal levels of the right and left channels vary significantly and independently, which interference would otherwise tends to degrade the quality of the reproduced sound.

As set forth above, in accordance with the present invention, higher quality sound can be achieved by providing sub-speakers which induce acoustic images at suitable points in the vehicle cabin.

Although specific arrangements and numbers of speakers have been disclosed above in terms of the preferred embodiment, these specific arrangements and numbers of speakers should be taken merely as examples and the invention should not be interpreted as being limited to these specific embodiments.

What is claimed is:

1. A speaker system for an automotive audio system comprising;

a plurality of main speakers so arranged in a vehicle cabin as to produce acoustic vibrations concentrated near the center of the vehicle cabin, each of said main speakers receiving one of a right and a left audio signal channel from an audio signal source to reproduce a single channel of acoustic vibrations;

one or more sub-speakers arranged in the vehicle cabin and connected to receive audio signals from said audio signal source, said sub-speakers being arranged to produce acoustic vibrations which interact with acoustic vibrations produced by said main speakers so as to form a plurality of acoustic images in the vehicle cabin, each of said acoustic images being formed in the vicinity of a passenger seat, a plurality of seat sensors for detecting the presence of passengers in corresponding seats; and means responsive to said seat sensors for controlling the distribution of said right and left audio signal channels between or among said sub-speakers in accordance with the distribution of passengers within the vehicle cabin indicated by said seat sensors.

2. A speaker system for an automotive audio system comprising:

a plurality of main speakers so arranged in a vehicle cabin as to produce acoustic vibrations concentrated near the center of the vehicle cabin, each of said main speakers receiving one of a right and a left audio signal channel from an audio signal source to reproduce a single channel of acoustic vibrations;

one or more sub-speakers arranged in the vehicle cabin and connected to receive audio signals from said audio signal source, said sub-speakers being arranged to produce acoustic vibrations which interact with acoustic vibrations produced by said main speakers so as to form a plurality of acoustic images in the vehicle cabin, each of said acoustic images being formed in the vicinity of a passenger seat, a plurality of seat sensors detecting the presence of a passenger on corresponding seats; and a controller associated with said seat sensors and controlling the amplitude of audio signals sent to each main speaker in accordance with the sensed distribution of passengers within the vehicle cabin to form said acoustic image in the vicinity of the vehicle seat occupied by said passenger.

3. The speaker system as set forth in claim 2, wherein said controller controls the relative amplitudes of the right and left audio channels in accordance with the distribution of passengers.

4. The speaker system as set forth in claim 2, wherein a first pair of sub-speakers are located near a front seat in said vehicle cabin along the central axis of the vehicle, the sub-speakers of said first pair facing opposite halves of the front seat relative to the central axis, and a second pair of sub-speakers are located near a rear seat in said vehicle cabin along the central axis of the vehicle, the sub-speakers of said second pair facing opposite halves of the rear seat.

5. The speaker system as set forth in claim 2, wherein said sub-speakers are mounted on seat backs of front seats in said vehicle cabin and face rearward.

6. The speaker system as set forth in claim 2, wherein said sub-speakers are mounted in front of respectively corresponding passenger seats.

7. The speaker system as set forth in claim 2, which further comprises a controller controlling the amplitude of audio signals sent to each of said sub-speakers in accordance with the difference between the amplitudes of the right and left audio channels.

8. The speaker system as set forth in claim 2, wherein said sub-speakers are each connected to receive an audio signal resulting from the mixing of said right and left audio signal channels.

9. A speaker system for an audio system in an automotive vehicle defining therein a vehicle cabin in which a plurality of seats are arranged, comprising:

a main speaker system including at least one pair of left-channel speaker and right-channel speaker for reproducing left-and right-channel audio signals from an audio source, said left-and right-channel speakers being arranged to concentrate acoustic vibration near the center of the vehicle cabin to form an acoustic image there about;

an auxiliary speaker system connected to said audio signal source for receiving audio signals for generating acoustic vibration to offset said acoustic image to a selected direction and at a selected magnitude; and a controller associated with said main and auxiliary speaker systems for automatically adjusting magnitude of acoustic vibration generated by said main speaker system and/or said auxiliary speaker system for causing offset of said acoustic image to a predetermined position.

10. A speaker system for an audio system in an automotive vehicle defining therein a vehicle cabin in which a plurality of seats are arranged, comprising:

a main speaker system including at least one pair of left-channel speaker and a right-channel speaker for reproducing left-right-channel audio signals from an audio source, said left-and right-channel speakers being arranged to concentrate acoustic vibration near the center of the vehicle cabin to form an acoustic image there about;

an auxiliary speaker system connected to said audio signal source for receiving audio signals for generating acoustic vibration to form acoustic images at preselected positions offsetting from the center to a selected direction and at a selected magnitude; and a controller associated with said main and auxiliary speaker system for automatically adjusting magnitude of acoustic vibration generated by said main speaker system and/or said auxiliary speaker system for causing offset of said acoustic images to predetermined positions.

* * * * *